United States Patent [19]

Munsell et al.

[11] Patent Number: 4,683,070

[45] Date of Patent: Jul. 28, 1987

[54] DETERMINATION OF METAL SOURCE IN USED OIL

[76] Inventors: Monroe W. Munsell, 180 Sutton Dr., Berkeley Heights, N.J. 07922; Richard F. Finn, 64 Juniper Way, Basking Ridge, N.J. 07920

[21] Appl. No.: 767,744

[22] Filed: Aug. 21, 1985

[51] Int. Cl.[4] ..... C10M 135/10; C10M 129/26

[52] U.S. Cl. ..... 252/33.4; 252/40.5; 252/40.7; 252/42.7; 252/965

[58] Field of Search ..... 252/40.7, 42.7, 40.5, 252/33.4, 408.1, 965

[56] References Cited

U.S. PATENT DOCUMENTS

| | | | |
|---|---|---|---|
| 2,472,552 | 6/1949 | Smith et al. | 252/965 |
| 2,744,069 | 5/1956 | Van Loon | 252/40.7 |
| 4,010,185 | 3/1977 | Groves, Jr. | 252/33.4 |
| 4,486,326 | 12/1984 | Gutierrez | 252/49.7 |

FOREIGN PATENT DOCUMENTS 2056482A 3/1981 United Kingdom .

OTHER PUBLICATIONS

"Direct Determination of Metals in Lubricating Oils Using Atomic-Absorption Spectrometry and Aqueous Inorganic Standards", Analyst 1980, vol. 105, pp. 919-921 by P. K. Hon, O. W. Lau and C. S. Mok-.-Department of Chemistry, The Chinese University of Hong Kong, Shatin, N. T., Hong Kong.

"Lubrication", vol. 70(2), pp. 13-24, 1984-Rapid Oil Analysis, R. W. Erickson and W. V. Taylor, Jr. Published by Texaco Inc., 2000 Westchester Avenue, White Plains, N.Y. 10650.

"Lubrication Engineering", vol. 34, 11, pp. 625-628 of Nov. 1978, Comprehensive Lube Oil Analysis Programs: A Cost-Effective Preventive Maintenance Tool by J. E. Steenbergen; Union Carbide Corp., Houston, Tex.

Analyst, Feb., 1983, vol. 108, pp. 254-260—"Analysis of Used Oils for Wear Metals by Wavelength Dispersive X-Ray Fluorescence Spectroscopy" Edward Searle and Christopher M. Thompson, Research Laboratory, London Transport Executive, 566 Chiswick High Road, London, W45RR, England.

Canadian Spectroscopy, "An Evaluation of Atomic Absorption Spectroscopy for the Determination of Wear Metals in Used Lubricating Oils", D. R. Jackson, C. Salama., R. Dunn, pp. 17-24, Jan. 1970, Published Montreal, Canada.

Society of Automotive Engineers Paper 770642—'-'Used Engine Oil Analyses—Review", By P. A. Asseff, The Lubrizol Corporation, pp. 1-11, Fuels and Lubricants Meeting of Jun. 7-9, 1977, Published by Society of Automotive Engineers, Inc. 400 Commonwealth Drive, Warrendale, Pa. 15096.

Analytical Chemistry, vol. 57, No. 5 of Apr. 1985,—"-Lubricants, Oils and Greases", By E. D. Archer, Texaco Research Center—Beacon, Texaco Inc., Beacon, N.Y.

Chem. Abstracts: 78:161793 (1973); 78:138517 (1973); 96:145637 (1982); 88:91896.

*Primary Examiner*—Jacqueline V. Howard

[57] ABSTRACT

A tracer metal, which is not present in engine parts subject to wear, is used to ascertain the source of metals in used oil as between lubricating oil additives and other sources, particularly wear of engine parts.

24 Claims, No Drawings

DETERMINATION OF METAL SOURCE IN USED OIL

FIELD OF THE INVENTION

The present invention relates to oil compositions, particularly motor oils, containing a tracer metal component to determine the source of another metal component, such as metal wear, corrosion, contamination, and/or an additive component of the motor oil.

BACKGROUND OF THE INVENTION

Current motor oil additives are either non-metal containing, or if they do contain metal, then the metals are generally calcium, magnesium, zinc, or sodium.

Recently it has been found that copper additives are particularly useful in motor oil as antioxidants. Such use has been described in Canadian Pat. No. 1,170,247 and U.K. Published Patent Application No. GB 2,056,482A both based on U.K. Application No. 7928146 by T. Colclough, F. A. Gibson and J. F. Marsh. There is generally little or no problem in formulating passenger car crankcase oils with copper additives. However, a problem has arisen in applying these copper additives to motor oils for diesel engines which are extensively used in trucks. It has become a common practice for many truck fleet operators to have samples of the engine oil periodically analyzed for metals in order to diagnose contamination, corrosion and particularly excessive wear and impending failure of engine parts. Such metal analysis will typically include: copper, which can indicate excessive wear of copper-lead bearings; iron, which can indicate excessive wear or rust of the engine; chrome, which can indicate excessive wear of chrome faced piston rings, etc. Adding a copper additive to the motor oil interferes with the copper analysis as there was no way to tell from the used oil analysis whether a high level of copper found by the analysis is due to excessive wear of copper-containing engine parts, and/or whether the copper is a component of the motor oil being used. Even if the fleet operator knows that the crankcase was initially filled with oil of a known copper content, the operator still does not generally know from the analysis if wear is occurring, particularly if make-up oil was added. Thus, the make-up oil may be obtained from different suppliers, who may or may not have a copper additive in the oil. Furthermore, even if both the original oil and all make-up oil are from the same supplier, there may be an accumulation of metals, including copper, due to varying oil losses due to volatility of the base oil, which accumulation interferes with determining accurately the source of the copper.

The problem is to find a reliable method of determining whether any copper in the oil is due to a copper additive used by the oil manufacturer, or is due to other sources such as wear of copper-containing parts, or whether the copper is from both an oil additive and wear. It also becomes important to determine the relative amount of copper individually due to an oil additive and to wear to indicate whether the wear is excessive.

SUMMARY OF THE INVENTION

It has been found that the above problems can be solved in an economical fashion by adding a small amount of a tracer metal, other than copper and other than a metal which is associated with engine wear or corrosion. Also the tracer metal should be a metal not currently in diesel oil formulations. The tracer metal should be oil soluble, or at least oil dispersable, and preferably should be easily and accurately measured in the used oil, as well as economical. While various metals such as potassium, lithium and tungsten could be used, barium has been found to be particularly desirable. Barium oil additives are well known and have been extensively used in the past in relatively large amounts in oil, but are now substantially obsolete and seldom used. By using both copper and barium additives together in a fixed predetermined ratio of copper to barium, e.g., a 1.6:1 ratio such as 80 ppm Cu to 50 ppm Ba, the source and amount of copper in used oil can now be accurately determined. For example, if the used oil showed no barium, then any copper is due to wear. If analysis showed 150 ppm copper and 60 parts of barium then the amounts of copper due to engine wear is $150-1.6\times60=54$, indicating both a metal build up as well as copper wear.

The copper may be blended into the oil as any oil soluble copper compound, i.e., soluble under normal blending conditions in the oil or additive package. The copper compound may be in the cuprous or cupric form.

The copper may be added as the copper salt of a synthetic or natural carboxylic acid. Examples include $C_{10}$ to $C_{18}$ fatty acids such as stearic or palmitic, but unsaturated acids such as oleic or branched carboxylic acids such as naphthenic acids of molecular weight from 200 to 500 or synthetic carboxylic acids are preferred because of the improved handling and solubility properties of the resulting copper carboxylates.

The copper may be in the form of copper dihydrocarbyl thio- or dithio-phosphates wherein one mole of cuprous or cupric oxide may be reacted with one or two moles of the dithiophosphoric acid respectively. Copper dihydrocarbyl dithiophosphates may be prepared in accordance with known techniques by first forming a dithiophosphoric acid, usually by reaction of an alcohol or a phenol with $P_2S_5$ and then neutralising the dithiophosphoric acid with a suitable copper compound. The dithiophosphoric acids may be represented by the formula:

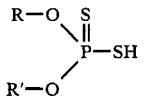

wherein R and R′ may be the same or different hydrocarbyl radicals containing from 1 to 18, preferably 2 to 12 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, i-butyl, secbutyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e. R and R′) in the dithiophosphoric acid will generally be about 5 or greater.

Other useful compounds are oil soluble copper dithiocarbamates of the general formula $(RR'NCSS)_nCu$ where n is 1 or 2 and R and R′ are the same or different as described above for the copper dihydrocarbyl dithiophosphate. Copper sulphonates, phenates, and acetyl acetonates, etc. may also be used.

The barium may be present in the form of oil soluble lubricating oil additives such as neutral or basic metal salts of sulphonic acids, alkyl phenols, sulphurised alkyl phenols, alkyl salicylates, naphthenates, and oil soluble mono- and di-carboxylic acids, etc.

The neutral or basic barium sulfonates are usually produced by heating a mixture comprising an oil-soluble alkaryl sulfonic acid with a barium base such as the oxide or hydroxide sufficient for neutralization of the sulfonic acid. Excess barium base is used to prepare an overbased additive which contains a dispersed carbonate complex formed by reacting the excess metal base with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example, those obtained by alkylating benzene, toluene, xylene, naphthalene, diphenyl and the halogen derivatives such as chlorobenzene, chlorotoluene and chloronaphthalene with polyolefins as for example, polymers from ethylene, propylene, isobutylene, etc. The resulting alkaryl sulfonates usually contain from about 9 to about 70 or more carbon atoms, preferably from about 16 to about 50 carbon atoms per alkyl substituted aromatic moiety.

Barium salicylate and naphthenate materials are known additives for lubricating oil compositions to improve their high temperature performance and to counteract deposition of carbonaceous matter on pistons (U.S. Pat. No. 2,744,069). Salicylate/naphthenate rust inhibitors are preferably the barium salts of aromatic acids having the general formula:

$$HOOC—ArlR_1—X_y(ArR_1OH)_n$$

where Ar is an aryl radical of 1 to 6 rings, $R_1$ is an alkyl group having from about 8 to 50 carbon atoms, preferably 12 to 30 carbon atoms (optimally about 12), X is a sulfur (—S—) or methylene (—$CH_2$—) bridge, y is a number from 0 to 4 and n is a number from 0 to 4.

Barium salts of sulfurized metal alkyl phenates may also be used. These salts, whether neutral or basic, are generally of compounds typified by the general formula:

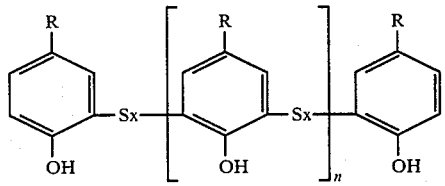

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

In general, the amount of added copper compound used in the oil formulations, such as crankcase motor oils, will be such to give copper concentrations of about 5 to about 500 ppm by weight of copper in the lubricant composition and preferably about 10 to 300, e.g. 60 to about 200 ppm. The amount of barium compound used is such as to give 5 to 500, e.g., 10 to 300, preferably 25 to 150, most preferably 40 to 100 ppm of barium. The copper and barium can be used in any relative ratio, such as 0.1 to 10, preferably about 1 to 5, most preferably 2 to 1 parts by weight of copper per part by weight of barium. Concentrates comprising about 5 to 90, e.g., 10 to 60 wt.%, copper and barium compounds in lubricating oil may be first formed in whatever ratio is desired and these may be included as components in various additive packages which will be used to blend finished lubricating oils. In this way, an accurate and constant copper/barium ratio can be maintained in the final oil formulations being produced.

The lubricants to which the products of this invention can be added include not only hydrocarbon oils derived from petroleum, but also include synthetic oils such as alkyl esters of dicarboxylic acids, polyglycols and alcohols; polyalphaolefins, alkyl benzene, organic esters of phosphoric acids, polysilicone oil, etc.

In the above compositions or concentrates, other conventional additives may also be present, including dyes, pour point depressants, antiwear agents such as tricresyl phosphate or zinc dialkyl dithiophosphates of 3 to 8 carbon atoms in each alkyl group, other antioxidants such as N-phenyl a-naphthylamine, t-octylphenol sulfide, 4,4'-methylene bis(2,6-di tertbutyl phenol), viscosity index improvers such as ethylene-propylene copolymers, polymethacrylates, polyisobutylene, alkyl fumarate-vinyl acetate copolymers, and the like, as well as ashless dispersants such as polyisobutylene succinic anhydride reacted with amines, hydroxy amines, polyols, etc., calcium and magnesium metal detergents such as carbon dioxide overbased alkylaryl sulfonates, etc.

Techniques for measuring metals in used oil include flame atomic-absorption spectroscopy, electrothermal atomic-absorption spectroscopy, optical emission spectroscopy, inductively coupled plasma emission spectroscopy, scanning electron microscopy-X-ray analysis and X-ray florescence spectroscopy (see P. K. Hon, O. W. Lau and C. S. Mok, "Direct Determination of Metals in Lubricating Oils and Aqueous Inorganic Standards", Analyst 1980, 105, pp. 919–921, and the references cited therein. Other related articles on analysis of used oils for metals are Lubrication, vol. 70(2), pp. 13–24 (1984); Lubrication Engineering, vol. 34, 11, pp. 625–628, November 1978; Analyst, February 1983, vol. 108, pp. 254–260; Canadian Spectroscopy, January 1970, pp. 17–24; SAE Paper 770642, Used Engine Oil Analyses—Review by P. A. Asseff, Fuels and Lubricants Meeting, June 7–9, 1977; and E. D. Archer, Lubricants, Oils and Greases in Analytical Chemistry, vol. 75, No. 5, April 1985.

The invention will be further indicated by reference to the following example.

EXAMPLE

A concentrate was prepared consisting of 76.6 wt.% mineral lubricating oil, 3.4 wt.% of the neutral barium salt of an alkaryl sulfonic acid, said sulfonic acid having an average molecular weight of about 1000 and being prepared by alkylation of benzene sulfonic acid with tetrapropylene and 20.0 wt% of cupric oleate. The weight ratio of copper to barium in said concentrate was 1.6 to 1.0.

A finished 15W40 crankcase motor oil composition was prepared containing a major amount of mineral lubricating oil, zinc dialkyl dithiophosphate, ashless dispersant of the succinimide type, magnesium and calcium sulfonates and sufficient of the above-noted concentrate to give about 80 ppm copper and 50 ppm barium in said finished oil composition.

An analysis was made of said oil from a field test delivery truck having an oil capacity of about 8 quarts operating on the above motor oil after about 7500 miles of operation.

The analysis of the used oil together with the fresh oil is summarized in the following table:

TABLE 1

| | Analysis of 15W40 Oil | |
|---|---|---|
| | Fresh oil | Used Oil |
| Cu, ppm | 80 | 105 |
| Ba, ppm | 50 | 62 |
| Pb, ppm | Nil | 21 |
| Cr, ppm | Nil | 3 |
| Zn, wt. % | 0.111 | 0.116 |
| Ca, wt. % | 0.098 | 0.105 |
| Mg, wt. % | 0.133 | 0.14 |

The analysis was carried out by atomic adsorption.

Table 1 shows that the initial copper to barium ratio was 1.6 to 1.0. Thus, the copper due to wear in the used oil can be calculated as follows:

$$105-1.6\times 62=6$$

While the above has illustrated the invention applied to copper and barium, the invention can be applied to other primary metals other than copper such as chromium, iron, lead, using either barium as the secondary or tracer metal, or other tracer metals such as potassium, tungsten or lithium can be used.

We claim:

1. A method of forming a motor oil to facilitate determination of the source of a primary metal in said motor oil after use in a motor engine, wherein said primary metal originates both as a component added to said oil as an additive and as a result of motor engine part wear, which method comprises the addition to said motor oil of said primary metal additive and an oil soluble tracer metal additive the sole source of said tracer metal in said oil being said tracer metal additive, said tracer metal additive and said primary metal additive being added to said motor oil in a fixed predetermined ratio to thereby permit calculating from said ratio and the amount of tracer metal in said oil after use, the amount of said primary metal in said used oil due to wear.

2. A method according to claim 1, wherein said primary metal is selected from the group consisting of copper, iron, lead and chromium.

3. A method according to claim 1, wherein said tracer metal is selected from the group consisting of barium, potassium, lithium and tungsten.

4. A method according to claim 1, wherein said tracer metal is barium.

5. A method according to claim 1, wherein said primary metal is added as copper oleate and said tracer metal is added as a neutral barium alkaryl sulfonate.

6. A method according to claim 5, wherein said copper oleate is added in an amount equivalent to 5 to 500 ppm copper and said barium sulfonate is added in an amount equivalent to 5 to 500 ppm barium.

7. A motor oil prepared according to claim 1.

8. A motor oil prepared according to claim 2.

9. A motor oil prepared according to claim 3.

10. A motor oil prepared according to claim 4.

11. A motor oil prepared according to claim 5.

12. A motor oil prepared according to claim 6.

13. An oil concentrate consisting essentially of a mineral lubricating oil and about 5 to 90 wt.% total of a copper compound and a barium compound.

14. A concentrate according to claim 13, wherein said copper compound is copper oleate and said barium compound is barium sulfonate.

15. A method of determining the source of a primary metal in motor oil after use, wherein said primary metal originates both as a component of an additive in fresh oil and also originates due to engine wear, which method comprises the addition to said motor oil of a tracer metal whose sole source in used oil is said addition, and then calculating, from the amount of said tracer metal in said used oil and the relative ratio of said primary metal and said tracer metal in said fresh oil, the amount of primary metal in said used oil due to wear.

16. A method according to claim 15, wherein said primary metal is copper.

17. A method according to claim 15, wherein said tracer metal is barium.

18. A method according to claim 15, wherein copper oleate is added to said oil in an amount equivalent to 5 to 500 ppm copper and barium sulfonate is added in an amount of 10 to 300 ppm barium.

19. A method of forming a motor oil to facilitate determination of the source of a primary metal in said oil after use, wherein said primary metal originates both as a component added to said oil as an additive and as a result of motor engine part wear, which method comprises introducing to unused motor oil (1) a primary metal additive wherein said primary metal is selected from the group consisting of copper, iron, lead and chromium and (2) an oil soluble tracer metal additive wherein said tracer metal is selected from the group consisting of barium, potassium, lithium and tungsten, said tracer metal additive and said primary metal additive being introduced to said unused motor oil in a fixed predetermined ratio to thereby permit calculating from said ratio and the amount of tracer metal in said oil after use, the amount of said primary metal in said used oil due to wear.

20. A method according to claim 19 wherein said primary metal additive comprises a copper additive, said copper additive is introduced to said unused motor oil in an amount sufficient to provide a concentration of about 5 to about 500 ppm by weight of copper therein, and wherein said tracer metal compound comprises an oil soluble barium compound, said barium compound being introduced to said unused motor oil in an amount sufficient to provide a concentration of from 5 to 500 ppm by weight of barium therein.

21. A method according to claim 20 wherein said copper additive and said barium additive are introduced to said unused motor oil in an amount sufficient to provide a ratio of from 0.1 to 10 parts by weight of copper per part by weight of barium.

22. A process according to claim 19 wherein said primary metal additive comprises an oil soluble copper compound selected from the group consisting of copper salts of synthetic or natural carboxylic acids, copper dihydrocarbyl thio- or dithio-phosphates, copper dithiocarbonates, copper sulphonates, copper phenates, and copper acetyl acetonates, said copper additive being introduced to said unused motor oil in an amount of from about 5 to 500 ppm by weight of copper therein, and wherein said tracer metal additive comprises an oil soluble barium compound, said barium compound being introduced to said unused motor oil in an amount sufficient to provide a concentration of from 5 to 500 ppm by weight of barium therein.

23. A method according to claim 22 wherein said copper additive and said barium additive are introduced to said motor oil in an amount sufficient to provide a ratio of from 0.1 to 10 parts by weight of copper per part by weight of barium therein.

24. A method according to claim 22 wherein said copper additive and said barium additive are introduced into said motor oil in an amount sufficient to provide a concentration in said motor oil of from about 10 to 300 ppm by weight of copper, and from 10 to 300 ppm by weight of barium, and wherein said copper additive and said barium additive are introduced in amounts sufficient to provide a ratio of from about 1 to 5 parts by weight of copper per part by weight of barium in said unused motor oil.

* * * * *